US009033479B2

(12) United States Patent
Kawate

(10) Patent No.: US 9,033,479 B2
(45) **Date of Patent: *May 19, 2015**

(54) LIQUID STORAGE CONTAINER MOUNTED ON LIQUID EJECTING APPARATUS

(71) Applicant: Seiko Epson Corporation, Tokyo (JP)

(72) Inventor: Hiroyuki Kawate, Hokuto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/181,555

(22) Filed: Feb. 14, 2014

(65) Prior Publication Data

US 2014/0160210 A1 Jun. 12, 2014

Related U.S. Application Data

(63) Continuation of application No. 13/359,470, filed on Jan. 26, 2012, now Pat. No. 8,678,572.

(30) Foreign Application Priority Data

Jan. 26, 2011 (JP) ..... 2011-013762

(51) Int. Cl.
*B41J 2/175* (2006.01)

(52) U.S. Cl.
CPC ..... *B41J 2/17556* (2013.01); *B41J 2/17513* (2013.01); *B41J 2/17566* (2013.01)

(58) Field of Classification Search
USPC ..... 347/85, 86
See application file for complete search history.

(56) References Cited

U.S. PATENT DOCUMENTS

| | | | |
|---|---|---|---|
| 6,082,851 | A | 7/2000 | Shihoh et al. |
| 6,520,630 | B1 | 2/2003 | Oda et al. |
| 6,722,762 | B2 | 4/2004 | Miyazawa et al. |
| 6,848,776 | B2 | 2/2005 | Nishioka et al. |

(Continued)

FOREIGN PATENT DOCUMENTS

| | | | |
|---|---|---|---|
| EP | 1 164 024 | A2 | 12/2001 |
| EP | 1772277 | A2 | 4/2007 |

(Continued)

OTHER PUBLICATIONS

European Search Report, dated May 8, 2012, of corresponding European Application No. 12152265.0. 5 pages.

(Continued)

*Primary Examiner* — Anh T. N. Vo
(74) *Attorney, Agent, or Firm* — Kilpatrick Townsend & Stockton LLP

(57) ABSTRACT

A liquid storage container which is mounted on a printer ejecting a liquid includes a liquid storage chamber that stores the liquid therein, a liquid supply portion that supplies the liquid to the ejecting head, a device chamber that is provided in a pathway supplying the liquid from liquid storage chamber to the liquid supply portion and includes a device in the inner portion thereof, and an air chamber that is provided in a pathway supplying air from the outside to the liquid storage chamber according to a decrease of the liquid in the liquid storage chamber, is filled with air in the inner portion, and prevents the liquid from being leaked to the outside by trapping the liquid when the liquid flows backward from the liquid storage chamber. In addition, among walls which surround the device chamber, at least one wall is adjacent to the air chamber.

9 Claims, 4 Drawing Sheets

(56) References Cited

U.S. PATENT DOCUMENTS

| | | | | |
|---|---|---|---|---|
| 7,404,628 | B2 | 7/2008 | Naka et al. | |
| 7,513,613 | B2 | 4/2009 | Ishizawa et al. | |
| 7,581,808 | B2 | 9/2009 | Ishizawa et al. | |
| 8,197,047 | B2 * | 6/2012 | Wanibe | 347/92 |
| 8,678,572 | B2 * | 3/2014 | Kawate | 347/86 |
| 2001/0024226 | A1 | 9/2001 | Sasaki | |
| 2009/0079804 | A1 | 3/2009 | Kimura | |
| 2009/0295890 | A1 | 12/2009 | Wanibe | |

FOREIGN PATENT DOCUMENTS

| | | | |
|---|---|---|---|
| EP | 2110250 | A1 | 10/2009 |
| EP | 2174788 | A1 | 4/2010 |
| JP | 2009-285889 | A | 12/2009 |
| WO | 2006/129882 | A1 | 12/2006 |

OTHER PUBLICATIONS

Extended European Search Report dated Oct. 9, 2012, of corresponding European Application No. 12152265.0. 14 pages.

Non-Final Office Action dated Apr. 5, 2013, of related U.S. Appl. No. 13/359,470.

Notice of Allowance dated Jul. 29, 2013, of related U.S. Appl. No. 13/359,470.

Notice of Allowance dated Nov. 5, 2013, of related U.S. Appl. No. 13/359,470.

* cited by examiner

LIQUID STORAGE CONTAINER MOUNTED ON LIQUID EJECTING APPARATUS

This application is a continuation of U.S. application Ser. No. 13/359,470 filed on Jan. 26, 2012, which claims priority under 35 U.S.C. §119 to Japanese Application No. 2011-013762 filed on Jan. 26, 2011, which are hereby incorporated by reference in their entireties.

BACKGROUND

1. Technical Field

The present invention relates to a liquid storage container which is applied to a liquid ejecting apparatus ejecting a liquid such as ink and stores the liquid therein.

2. Related Art

A printing apparatus which prints an image by ejecting ink onto a printing medium is widely used. In the printing apparatus, the image is printed by ejecting the ink from an ejecting head while reciprocating a carriage on which the ejecting head is provided on the printing medium. Moreover, the ejected ink is stored in an exclusive storage container referred to as an ink cartridge and mounted on the carriage.

The ink cartridge may include predetermined devices. As an example of the predetermined devices, there is a residual quantity sensor for detecting the residual ink quantity of the ink cartridge. The residual quantity sensor is disposed in a chamber referred to as a sensor chamber in which the periphery is surrounded by walls. The sensor chamber is configured so as to be filled with ink while the ink remains in the ink cartridge. Accordingly, the residual quantity sensor detects whether or not the sensor chamber is filled with the ink, and therefore, the residual quantity sensor detects the residual ink quantity in the ink cartridge.

In addition, a circuit substrate is provided in the vicinity of a device chamber into which devices such as a sensor are accommodated, and the devices are electrically connected to the circuit substrate. Moreover, the ink cartridge is mounted on the printing apparatus, and therefore, the devices such as the residual quantity sensor are electrically connected to the printing apparatus via the circuit substrate. In addition, a memory for storing various information such as the ink type or the date of manufacture, and the like are also mounted on the circuit substrate. For example, as this kind of ink cartridge, the ink cartridge described in JP-A-2009-285889 is known.

In the ink cartridge described in JP-A-2009-285889, the sensor chamber is separated from the walls and adjacent to a bubble separation chamber. The sensor chamber and the bubble separation chamber are filled with ink in a state where the ink is stored in the ink cartridge. In this state, for example, if the user drops the ink cartridge by mistake, impact due to the ink in the adjacent bubble separation chambers is transmitted to the sensor chamber via the walls when the ink cartridge collides with a floor. Therefore, there is a concern that damage may be applied to the residual quantity sensor installed in the sensor chamber or the memory provided in the vicinity of the sensor chamber, or the like. In addition, the above-described problem is similarly generated in a cartridge which includes devices other than the sensor.

SUMMARY

An advantage of some aspects of the invention is to provide a technology capable of avoiding damage to a device such as a residual quantity sensor even when impact is applied to a liquid storage container such as dropping of the liquid storage container.

According to an aspect of the invention, there is provided a liquid storage container which is mounted on a liquid ejecting apparatus ejecting a liquid from an ejecting head and supplies the liquid to the ejecting head including a liquid storage chamber that stores the liquid therein, a liquid supply portion that supplies the liquid to the ejecting head, a device chamber that is provided in a pathway supplying the liquid from the liquid storage chamber to the liquid supply portion and includes a device in the inner portion thereof, and an air chamber that is provided in a pathway supplying air from the outside to the liquid storage chamber according to a decrease of the liquid in the liquid storage chamber, is filled with air in the inner portion, and prevents the liquid from being leaked to the outside by trapping the liquid when the liquid flows backward from the liquid storage chamber, wherein among walls which surround the device chamber, at least one wall is adjacent to the air chamber.

In this way, in the liquid storage container of the aspect of the invention, among walls which surround the device chamber, at least one wall is adjacent to the air chamber. Thereby, even when the liquid storage container is dropped and impact is applied to the liquid storage container, since the inner portion of the air chamber is filled with air, the impact is not applied to the device chamber from the air chamber. Therefore, compared to the case where the device chamber comes in contact with the chamber which stores liquid, since the impact applied to the device provided in the device chamber is absorbed, damage to the device can be avoided.

In the liquid storage container of the aspect of the invention, among the walls which surround the device chamber, a wall other than walls which partition the device chamber from the outside may be adjacent to the air chamber.

In this way, due to the fact that the wall other than walls which partition the device chamber from the outside is adjacent to the air chamber, since the device chamber is not adjacent to the chamber which stores the ink, even when the liquid storage container is dropped and impact is applied to the liquid storage container, impact due to the liquid is not applied to the device chamber from the adjacent chamber. Thereby, since the impact, which is applied to the device provided in the device chamber, is further absorbed, damage to the device can be further avoided.

In the liquid storage container of the aspect of the invention, the device may be a sensor. In this way, since the device is a sensor, it is also possible to detect a residual quantity of the stored liquid.

In the liquid storage container of the aspect of the invention, among walls which partition the device chamber from the outside in the walls which surround the device chamber, at least one wall may be adjacent to another device. According to the configuration, even when the liquid storage container is dropped and impact is applied to the liquid storage container, as described above, since the impact is not applied to the device chamber from the air chamber, it is difficult for the impact to be applied to the other device which is separated from the walls and adjacent to the device chamber. Thereby, damage to the other device can be also avoided.

In the liquid storage container of the aspect of the invention, the other device may be a memory. In this way, due to the fact that the other device is the memory, it is possible to store information such as the kind of the stored liquid and the date of manufacture.

In the liquid storage container of the aspect of the invention, the center of gravity of the liquid storage container exists in the liquid storage chamber when the liquid storage chamber stores the liquid, and a portion in which the liquid storage chamber exists is larger than a portion in which the air chamber exists in a circumference of the center of gravity.

When the liquid storage container is dropped, since it is highly possible that the liquid storage container drops in the state where the air chamber side faces upward if considering the center of gravity of the liquid storage container, it is possible to suppress the air chamber from being directly subjected to the impact at the time of the dropping according to the configuration.

In the liquid storage container of the aspect of the invention, a fixing lever that fixes the liquid storage container to the liquid ejecting apparatus may be provided at a side wall close to the device chamber.

In the case where the liquid storage container is dropped, since the fixing lever is disposed so as to be close to the device chamber adjacent to the air chamber, the impact applied to the fixing lever can be decreased when the liquid storage container collides with a floor.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, in order to explain the contents of the above-described invention, embodiments will be explained according to the following order.

A. First Embodiment

B. Second Embodiment

A. First Embodiment

Figure 1:
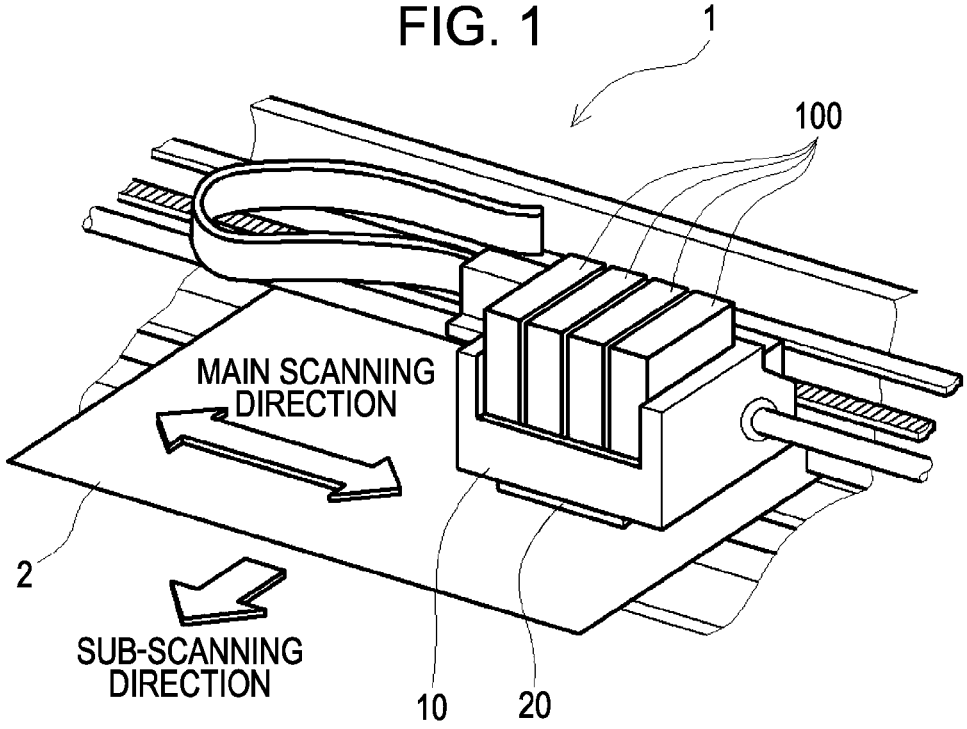
FIG. 1 is an explanatory view exemplifying a state where an ink cartridge is mounted on a carriage of an ink jet printer in a first embodiment of the invention.

FIG. 1 is an explanatory view exemplifying a state where an ink cartridge 100 is mounted on a carriage 10 of an ink jet printer 1 in a first embodiment of the invention. As shown in FIG. 1, the carriage 10 which reciprocates on a printing medium 2 is provided on the ink jet printer 1, and the ink cartridge 100 is mounted on the carriage 10. An ejecting head 20 which ejects the ink is provided in a lower surface side (side facing the printing medium 2) of the carriage 10 for each ink cartridge 100, and the ink stored in the ink cartridge 100 is supplied to the ejecting head 20 and ejected from the ejecting head 20 toward the printing medium 2. Moreover, the illustrated ink jet printer 1 prints an image by using cyan ink (C ink), magenta ink (M ink), yellow ink (Y ink), and black ink (K ink). According to this, four ink cartridges 100 of the ink cartridge 100 which stores the C ink, the ink cartridge 100 which stores the M ink, the ink cartridge 100 which stores the Y ink, and the ink cartridge 100 which stores the K ink are mounted on the carriage 10.

Figure 2A:
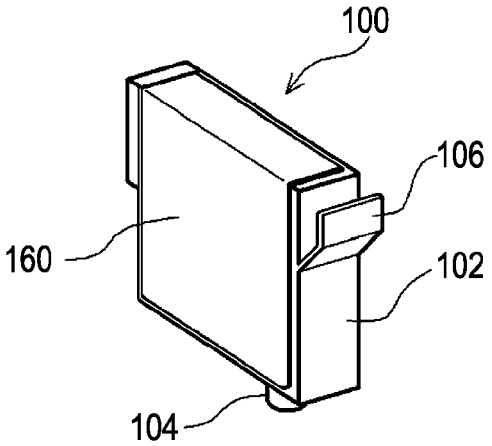
FIGS. 2A and 2B are perspective views showing an appearance configuration of the ink cartridge which is mounted on the carriage.
Figure 2B:
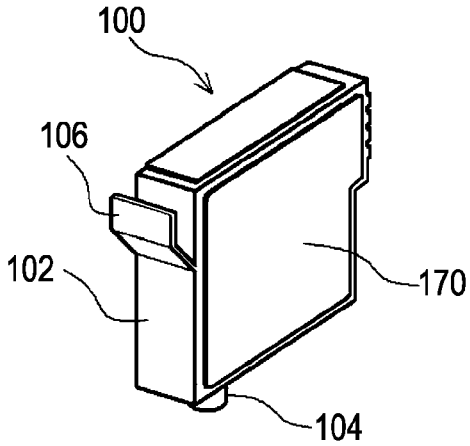

FIGS. 2A and 2B are perspective views showing an appearance configuration of the ink cartridge 100 which is mounted on the carriage 10 in FIG. 1. As shown in FIGS. 2A and 2B, the ink cartridge 100 is mainly configured by a cartridge main body 102 having an approximately rectangular shape. The cartridge main body 102 is formed of a hard resin material. As shown in FIG. 2A, in the cartridge main body 102, a display label 160 is stuck so as to be bent from the front side surface to the upper surface.

In addition, as shown in FIG. 2B, a sealing film 170 is stuck to the rear side surface of the cartridge main body 102. As described below, the rear side surface of the cartridge main body 102 is opened, and the ink can be stored in the ink cartridge 100 for the first time by sticking the sealing film 170 on the opening and sealing the ink. Moreover, an ink supply portion 104 for supplying the ink toward the ejecting head 20 of the carriage 10 is provided on the bottom surface of the cartridge main body 102.

In addition, as shown in FIGS. 2A and 2B, a fixing lever 106 for fixing the ink cartridge 100 to the carriage 10 when mounting the ink cartridge 100 on the carriage 10 is provided in one side surface of the sides of the cartridge main body 102.

Figure 3:
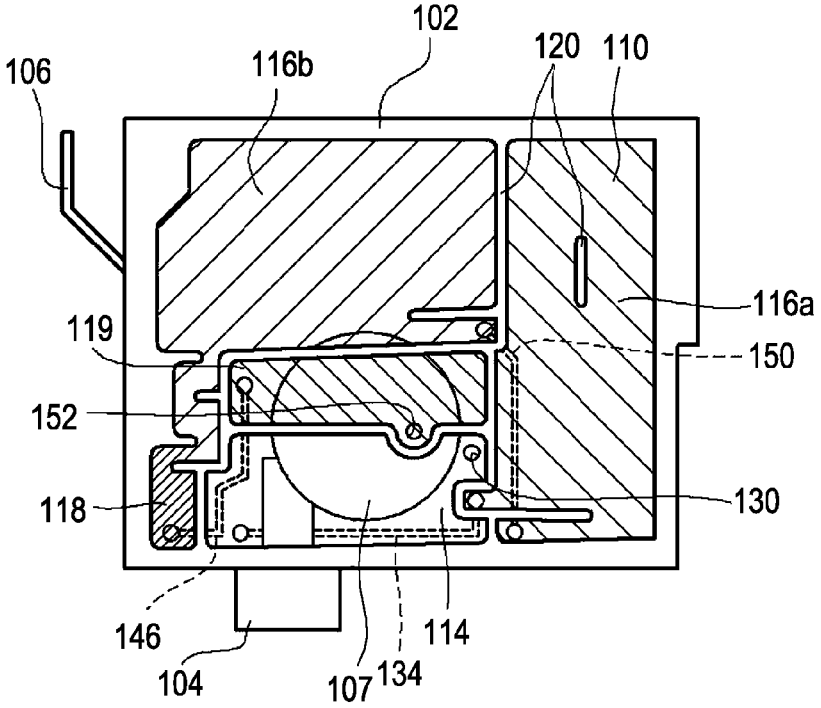
FIG. 3 is a plan view showing an inner structure of the ink cartridge by peeling a sealing film which is stuck to a rear side of a cartridge main body.

FIG. 3 is a plan view showing the inner structure of the ink cartridge 100 in FIGS. 2A and 2B by peeling the sealing film 170 which is stuck to the rear side surface of the cartridge main body 102. As shown in FIG. 3, if the sealing film 170 which is stuck to the rear side of the cartridge main body 102 is peeled, a largely opened concave portion 110 appears. In addition, the concave portion 110 is mainly divided into five regions by a plurality of walls 120 which are vertically and horizontally provided. Moreover, five chambers are formed between the concave portion 110 and the sealing film 170 by sticking the sealing film 170 onto the rear side of the cartridge main body 102 and sealing the concave portion 110.

Among the five chambers, as shown by an oblique line in FIG. 3, a first ink storage chamber 116*a* is provided at the right side of FIG. 3, and a second ink storage chamber 116*b* is provided at the upper left of FIG. 3. A sensor chamber 118 shown by a fine oblique line is provided at the lower left in FIG. 3 with respect to the second ink storage chamber 116*b*. A residual quantity sensor (not shown) is provided in the sensor chamber 118. In addition, a buffer chamber 119 is obliquely provided to the upper right of the sensor chamber 118. Moreover, the buffer chamber 119 communicates with a pressure regulation chamber 107 by a small round communicating hole 152. A membrane valve, a spring (all not shown), and the like are housed in the pressure regulation chamber 107, and the pressure regulation chamber includes a function which regulates pressure of the ink supplied to the carriage 10.

Moreover, the first ink storage chamber 116*a* and the second ink storage chamber 116*b* are connected to each other by an ink passage 150, and the sensor chamber 118 and the buffer chamber 119 are connected to each other by an ink passage 146. Accordingly, when the ink is ejected from the ejecting head 20, after the ink flows from the communicating hole 152 into the pressure regulation chamber 107 via the second ink storage chamber 119, the sensor chamber 118, and the buffer chamber 116*b* from the first ink storage chamber 116*a*, the ink is supplied from the ink supply portion 104 to the ejecting head 20.

In addition, as shown in FIG. 3, an air chamber 114 is also provided at the lower left in FIG. 3 with respect to the first ink storage chamber 116*a*. A communicating hole 130 is provided at the air chamber 114, and as described hereinafter, the communicating hole is connected to a hole open to the atmosphere via an air passage which is provided at the front side of the cartridge main body 102. In addition, the air chamber 114 is connected to the above-described first ink storage chamber 116*a* by an air passage 134. When the ink flows backward from the first ink storage chamber 116*a* due to an ambient temperature change, a posture change of the ink cartridge 100, or the like, the air chamber 114 traps the ink in the inner portion and prevents the ink from moving further upward and being leaked from the ink cartridge 100.

Figure 4:
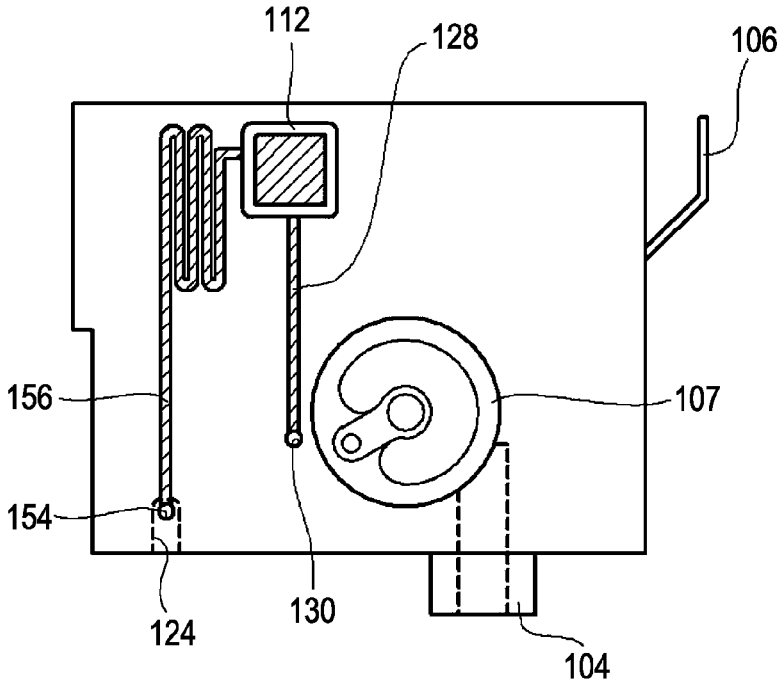
FIG. 4 is a plan view showing the inner structure of the ink cartridge by peeling a display label which is stuck to a front side of the cartridge main body.

FIG. 4 is a plan view showing the inner structure of the ink cartridge 100 in FIGS. 2A and 2B by peeling the display label 160 which is stuck to the front side of the cartridge main body 102. As shown in FIG. 4, a plurality of grooves appear if the display label 160 attached to the front side of the cartridge main body 102 is peeled. In FIG. 4, the grooves are indicated by oblique lines. Passages are formed between each groove and the display label 160 by sticking the display label 160 onto the front side of the cartridge main body 102 and sealing the grooves.

The passages include a communicating hole 154 which communicates with a hole open to the atmosphere 124 opened to the bottom surface of the cartridge main body 102, as the starting end; an upstream side elongated air passage 128 which meanders while changing direction several times; a downstream side elongated air passage 156 which has the communicating hole 130 described by FIG. 3 as the termination; and an approximately rectangular air reservoir 112 which is provided between the upstream side air passage 156 and the downstream side air passage 128 and formed in a shallow concave shape, or the like. Moreover, the surface configuration of the pressure regulation chamber 107 is shown in the vicinity (right side in FIG. 4) of the communicating hole 130.

Here, for the easy understanding of the inner structure of the ink cartridge 100 in the embodiment, the explanation is performed based on the configuration which simplifies the entire structure and changes a portion of the structure.

Figure 5A:
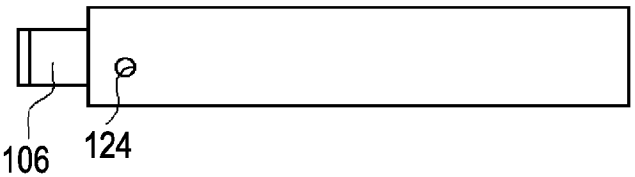
FIGS. 5A to 5D are structure views showing a simplified inner structure of the ink cartridge.
Figure 5B:
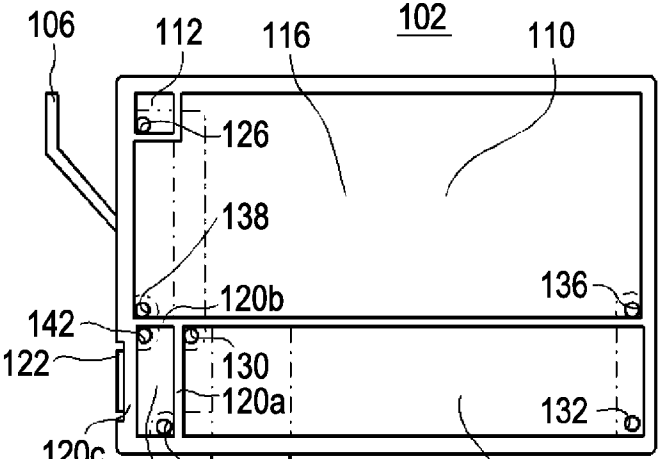
Figure 5C:
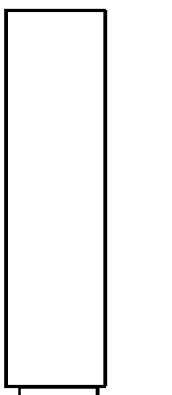
Figure 5D:
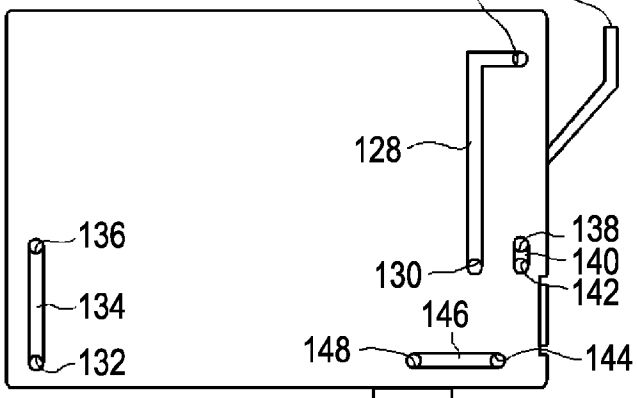

FIGS. 5A to 5D are structure views showing a simplified inner structure of the ink cartridge 100 shown in FIGS. 3 and 4. In FIGS. 5A to 5D, FIG. 5A is a top view of the cartridge main body 102 when viewed from the upper side, FIG. 5B is a rear view of the cartridge main body 102 when viewed from the rear side, FIG. 5C is a side view of the cartridge main body 102 when viewed from the side, and FIG. 5D is a front view of the cartridge main body 102 when viewed from the front side.

In FIGS. 5A to 5D, as shown in FIG. 5A, the hole open to the atmosphere 124 is provided on not the bottom surface of the cartridge main body 102 but the upper surface thereof. Moreover, as shown in FIG. 5B, the air reservoir 112 is provided at the upper left corner in the rear side of the cartridge main body 102. The air chamber 114 is provided at the lower portion of the cartridge main body 102 and occupies a large portion of the lower portion. On the other hand, the ink storage chamber 116 is configured of a single chamber, provided on the upper portion of the cartridge main body 102, and occupies a large portion of the upper portion.

The sensor chamber 118 is provided at the lower left side of the cartridge main body 102. Accordingly, among walls which surround the sensor chamber 118, a wall 120*a* is adjacent to the air chamber 114, and a wall 120*b* is adjacent to the ink storage chamber 116. The other walls are the walls which partition the sensor chamber from the outside. Among the walls which partition the sensor chamber 118 from the outside, a wall 120*c* is adjacent to a circuit substrate 122 which is provided in the outer portion of the cartridge main body 102. A residual quantity sensor (not shown) in the sensor chamber 118 is electrically connected to the circuit substrate 122 via the wall 120*c*. Memory (not shown) for storing various information such as the ink type or the date of manufacture, and the like are mounted on the circuit substrate 122. The circuit substrate 122 is electrically connected to the ink jet printer 1 in a state where the ink cartridge 100 is mounted on the carriage 10.

Moreover, the fixing lever 106 is provided at the side surface near to the sensor chamber 118 among the surfaces of the sides of the carriage main body 102.

The air reservoir 112 communicates with the hole open to the atmosphere 124. A communicating hole 126 is provided in the air reservoir 112, and as shown in FIG. 5D, the air reservoir communicates with the front side of the carriage main body 102.

In the rear side of the cartridge main body 102, the communicating hole 126 is connected to the communicating hole 130 via the air passage 128. As described above, the communicating hole 130 communicates with the air chamber 114 in the rear side of the cartridge main body 102. Moreover, a communicating hole 132 is provided in the air chamber 114 and communicates with the front side of the cartridge main body 102. In the front side, the communicating hole 132 is connected to a communicating hole 136 via the air passage 134. The communicating hole 136 communicates with the ink storage chamber 116 which is positioned at the rear side of the cartridge main body 102.

In addition, a communicating hole 138 is provided in the ink storage chamber 116 and communicates with the front side of the cartridge main body 102. In the front side, the communicating hole 138 is connected to a communicating hole 142 via an ink passage 140. The communicating hole 142 communicates with the sensor chamber 118 in the rear side of the cartridge main body 102. A communicating hole 144 is provided in the sensor chamber 118 in addition to the communicating hole 142 and communicates with the front side of the cartridge main body 102. In the front side, the communicating hole 144 is connected to the communicating hole 148 via an ink passage 146. The communicating hole 142 communicates with the ink supply portion 104. Moreover, in FIGS. 5A to 5D, for simplicity, a buffer chamber 119, the pressure regulation chamber 107, and the like are omitted.

Accordingly, in FIGS. 5A to 5D, when ink is ejected from the ejecting head 20, the ink is supplied from the ink storage chamber 116 to the ejecting head 20 via the communicating hole 138, the ink passage 140, the communicating hole 142, the sensor chamber 118, the communicating hole 144, and the ink supply portion 104.

In addition, the ink storage chamber 116 is connected to the air chamber 114 via the air passage 134, and the air chamber 114 is opened to the atmosphere via the communicating hole 130, the air passage 128, the communicating hole 126, the air reservoir 112, and the hole open to the atmosphere 124. As described above, even in the case where the ink flows backward from the ink storage chamber 116 according to the temperature change, the posture change, or the like, the air chamber 114 traps the ink in the inner portion. Therefore, the ink is prevented from moving further to the upstream side and being leaked from the ink cartridge 100.

On the other hand, the sensor chamber 118, which is positioned further downstream from the ink storage chamber 116, is filled with ink in a state where the ink exists in the ink storage chamber 116. Accordingly, the residual quantity sensor (not shown), which is installed in the sensor chamber 118, detects the residual ink quantity in the ink cartridge 100 according to detecting whether or not the sensor chamber 118 is filled with ink. The detected result is transmitted to the ink jet printer 1 via the circuit substrate 122.

In the embodiment, as shown in FIG. 5B, among the walls which surround the sensor chamber 118 in which the residual quantity sensor (not shown) is positioned, the right wall 120*a* is adjacent to the air chamber 114 as described above while the upper wall 120*b* is adjacent to the ink storage chamber 116. That is, the chamber which stores the ink is adjacent to the upside of the sensor chamber 118, but the chamber which is filled with air is adjacent to the right side of the sensor chamber 118.

Thereby, even in the case where the user accidentally drops the ink cartridge 100 containing ink, according to the following cause, damage to the residual quantity sensor (not shown) installed in the sensor chamber 118 or the memory (not shown) provided to be adjacent to the sensor chamber 118 can be avoided.

That is, when the ink cartridge 100 collides with a floor, the impact due to the stored ink is transmitted to the sensor chamber 118 via the wall 120*b* from the ink storage chamber 116. However, since the inner portion of the air chamber 114 is air, the impact from the air chamber 114 is not applied to the sensor chamber. Therefore, the impact which is applied to the residual quantity sensor, the memory, and the like is absorbed to that extent. As a result, damage to the devices can be avoided.

Moreover, in the embodiment, when considering the center of gravity of the ink cartridge 100, the center of gravity does not exist at the air chamber 114 side which is filled with air, but exists at the ink storage chamber 116 side which stores the ink. In addition, with respect to the circumference of the center of gravity, the volume of the portion in which the ink storage chamber 116 exists is larger than the volume of the portion in which the air chamber 114 exists. Thereby, when the user drops the ink cartridge 100 by mistake, it is highly possible that the ink cartridge 100 drops in the state where the air chamber 114 side faces upward.

On the other hand, the fixing lever 106 is provided at the side wall which is close to the sensor chamber 118 adjacent to the air chamber 114. Accordingly, when the ink cartridge 100 collides with a floor, the impact of the collision which is applied to the fixing lever 106 can be decreased.

B. Second Embodiment

Figure 6A:
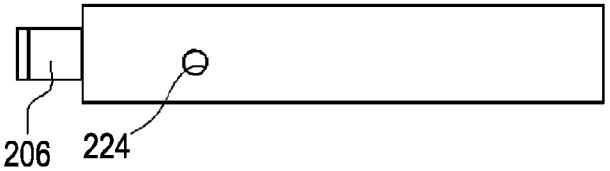
FIGS. 6A to 6D are structure views showing a simplified inner structure of the ink cartridge in a second embodiment of the invention.
Figure 6B:
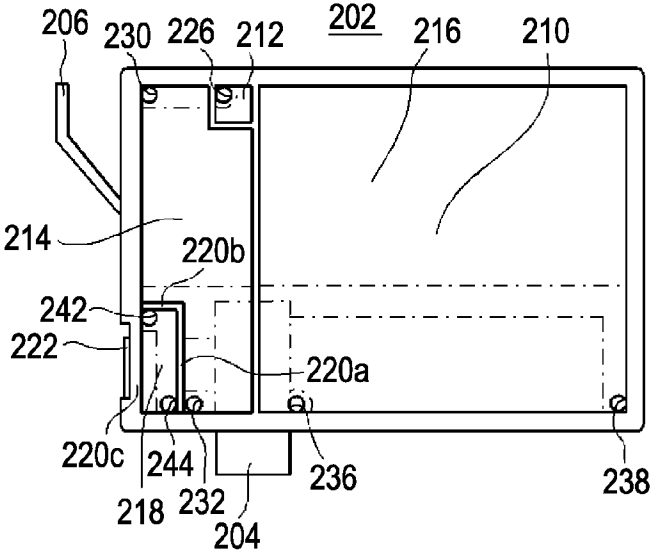
Figure 6C:
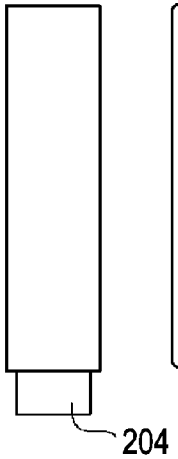
Figure 6D:
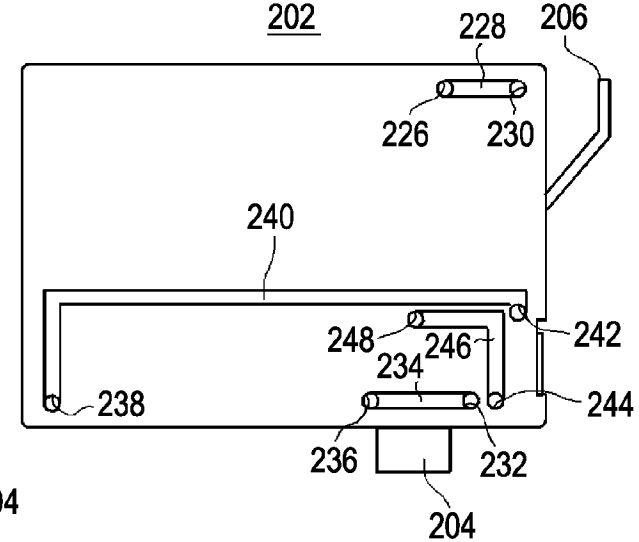

FIGS. 6A to 6D are structure views showing a simplified inner structure of the ink cartridge in a second embodiment of the invention. In FIGS. 6A to 6D, FIG. 6A is a top view of a cartridge main body 202 when viewed from the upper side, FIG. 6B is a rear view of the cartridge main body 202 when viewed from the rear side, FIG. 6C is a side view of the cartridge main body 202 when viewed from the side, and FIG. 6D is a front view of the cartridge main body 202 when viewed from the front side.

The differences between the present embodiment and the above-described first embodiment are the following. That is, in the first embodiment, among walls which surround the sensor chamber 118, the upper wall 120*b* is adjacent to the ink storage chamber 116 while the right wall 120*a* is adjacent to the air chamber 114. In contrast, in the second embodiment, among walls which surround a sensor chamber 218, a right wall 220*a* and an upper wall 220*b* are all configured so as to be adjacent to an air chamber 214. In other words, all walls other than the walls which partition the sensor chamber from the outside are configured so as to be adjacent to the air chamber 214.

That is, in the second embodiment, an air reservoir 212 is provided so as to be near to the left side of the upper portion of the cartridge main body 202. The air chamber 214 is provided at the left side of the cartridge main body 202 and occupies a large portion of the left side portion. An ink storage chamber 216 is provided at the right side of the cartridge main body 202 and occupies a great portion of the right side portion. The sensor chamber 218 is provided at the left side of the lower portion of the cartridge main body 202, and as described above, is positioned so as to be adjacent to the air chamber 214 via the walls 220*a* and 220*b*. Accordingly, in the second embodiment, the upper portion and the right portion of the sensor chamber 218 is adjacent to the chamber which is filled with air, but is not adjacent to the chamber which stores the ink at all.

Thereby, even when the user drops accidentally the ink cartridge containing ink, according to the following cause, damage to the residual quantity sensor (not shown) installed in the sensor chamber 218 or the memory (not shown) provided to be adjacent to the sensor chamber 218 can be avoided. That is, when the ink cartridge collides with a floor, since the impact due to the ink is not transmitted to the sensor chamber 218 from the adjacent chambers, the impact which is applied to the residual quantity sensor, the memory, and the like is greatly absorbed, and damage to the devices can be avoided.

Moreover, in the second embodiment, since the other configurations and operations are similar to those of the first embodiment, the descriptions are omitted.

As described above, various embodiments are described. However, the invention is not limited to all the above-described embodiments and can be performed as various aspects within the scope which does not depart the gist.

What is claimed is:

1. A liquid storage container configured to be mounted on a liquid ejecting apparatus, the liquid storage container comprising:

a liquid storage chamber configured to store a liquid therein;

a liquid supply portion configured to supply the liquid to the liquid ejecting apparatus;

an air space filled with air separated from the liquid storage chamber by a first wall located between the liquid storage chamber and the air space, the air space being located between the first wall and a third wall;

a circuit substrate formed on a second wall located between the air space and the circuit substrate;

a device space located between the second wall and a third wall, the device space not being located adjacent to any chamber which stores the liquid; and a fixing lever that is configured to fix the liquid storage container to the liquid ejecting apparatus, the fixing lever and the circuit substrate being provided at a same one side surface among side surfaces of the liquid storage container.

2. The liquid storage container according to claim 1, the air space being located between the liquid supply portion and the circuit substrate.

3. The liquid storage container according to claim 2, the circuit substrate having a memory unit.

4. The liquid storage container according to claim 3, the liquid supply portion provided on a third fourth wall that is intersecting with the first wall and the second wall.

5. The liquid storage container according to claim 4, wherein the fixing lever is provided at the second wall.

6. The liquid storage container according to claim 5, the air space being located between the liquid supply portion and the fixing lever.

7. The liquid storage container according to claim 6, wherein a center of gravity of the liquid storage container exists in the liquid storage chamber when the liquid storage chamber stores the liquid, and a portion in which the liquid storage chamber exists is larger than a portion in which the air space exists in a circumference of the center of gravity.

8. The liquid storage container according to claim 1, wherein the air space is located between the liquid storage chamber and the fixing lever.

9. The liquid storage container according to claim 1, wherein the fixing lever is provided near to the device space.

* * * * *